US006683635B2

(12) United States Patent
Suzuki

(10) Patent No.: US 6,683,635 B2
(45) Date of Patent: Jan. 27, 2004

(54) THERMAL PRINTER

(75) Inventor: Michio Suzuki, Tagata-gun (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 162 days.

(21) Appl. No.: 10/061,853

(22) Filed: Jan. 31, 2002

(65) Prior Publication Data

US 2002/0071021 A1 Jun. 13, 2002

Related U.S. Application Data

(63) Continuation of application No. PCT/JP01/04658, filed on Jun. 1, 2001.

(30) Foreign Application Priority Data

Jun. 1, 2000 (JP) ..... 2000-164820

(51) Int. Cl.[7] ..... B41J 2/315
(52) U.S. Cl. ..... 347/171
(58) Field of Search ..... 347/171, 172, 347/184, 214, 215, 222, 211, 220; 400/120.01, 120.02

(56) References Cited

U.S. PATENT DOCUMENTS

RE33,496 E * 12/1990 Matsuno et al. ..... 347/184
4,990,930 A * 2/1991 Ludden et al. ..... 347/172
5,355,152 A * 10/1994 Porter et al. ..... 347/214

FOREIGN PATENT DOCUMENTS

| | | |
|---|---|---|
| EP | 0 422 927 A2 | 4/1991 |
| JP | 7-047724 A | 2/1995 |
| JP | 8-090833 A | 4/1996 |
| JP | 8-118697 A | 5/1996 |
| JP | 8-258302 A | 10/1996 |

OTHER PUBLICATIONS

Patent Abstracts of Japan, vol. 2000, No. 65, Sep. 22, 2000 and JP 2000–071574 A (Canon Inc.), Mar. 7, 2000—Abstract only.

* cited by examiner

*Primary Examiner*—Lamson Nguyen
*Assistant Examiner*—K. Feggins
(74) *Attorney, Agent, or Firm*—Frishauf, Holtz, Goodman & Chick, P.C.

(57) ABSTRACT

A thermal printer includes a thermal head and a head driver for driving the thermal head so as to decrease the applied energy to the thermal head for a print area where copying is unnecessary below that for a print area where copying is necessary. By so doing, the applied energy and the printing speed can be made most suitable in the thermal printer that prints onto a recording medium having a print area where copying is unnecessary and a print area where copying is necessary.

20 Claims, 5 Drawing Sheets

THERMAL PRINTER

CROSS-REFERENCE TO RELATED APPLICATIONS

This is a Continuation Application of PCT Application No. PCT/JP01/04658, filed Jun. 1, 2001, which was not published under PCT Article 21(2) in English.

This application is based upon and claims the benefit of priority from the prior Japanese Patent Application No. 2000-164820, filed Jun. 1, 2000, the entire contents of which are incorporated herein by reference.

BACKGROUND OF THE INVENTION

1. Field of the Invention

The present invention relates to a thermal printer for printing characters, bar codes, etc. onto delivery slips, for example.

2. Description of the Related Art

In the distribution business, such as a home delivery system, it is required to attach delivery slips to parcels. Such a delivery slip is roughly divided into a section that serves a function as a tag and a section that serves a function as a slip. The tag is attached to a parcel to display identity information therefor and remains attached after the parcel has been delivered to a consignee. To take the home delivery system as an example, the slip is generally composed of an invoice and a trader's management slip. The invoice is a slip for notifying that a parcel has been delivered. The trader's management slip is a slip that the deliverer takes away for management purposes at the delivery of the parcel to a consignee. In any case, the invoice and the trader's management slip are separated from the delivery slip at the parcel has been delivered to a consignee or a substitute therefor.

Here, in the case of a delivery slip to be attached to a parcel, since entries in the invoice and the trader's management slip in the slip section are substantially identical to each other, copy paper is generally used in the slip section.

In an attempt to cause a thermal printer to print a bar code and characters on a delivery slip which uses a recording medium with copy-disabled area for the tag section and a recording medium with a copy-enabled area for the slip section, determining the energy applied to the thermal head to suit the recording medium section having the copy-enabled area results in a problem of wasteful consumption of energy in the copy-disabled area.

Moreover, determining the printing speed to suit the copy-enabled area results in a lower printing speed than is necessary in the copy-disabled area. There is a consequent problem that much time is required to issue one delivery slip.

It is an object of the present invention to provide a thermal printer, adapted to make printing onto a recording medium having a print area where copying is unnecessary and a print area where copying is required, which allows the applied energy and printing speed to be set most suitably.

BRIEF SUMMARY OF THE INVENTION

According to the present invention, there is provided a thermal printer that makes printing onto a recording medium having a print area where copying is unnecessary and a print area where copying is necessary on one page, characterized by comprising: a thermal head; a thermal head driving means for driving the thermal head so as to decrease the applied energy to the thermal head for the print area where copying is unnecessary below that for the print area where copying is necessary.

According to the present invention, in a thermal printer adapted to print onto a recording medium having a print area where copying is unnecessary and a print area where copying is required, the applied energy and the printing speed can be set most suitably.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Figure 1:
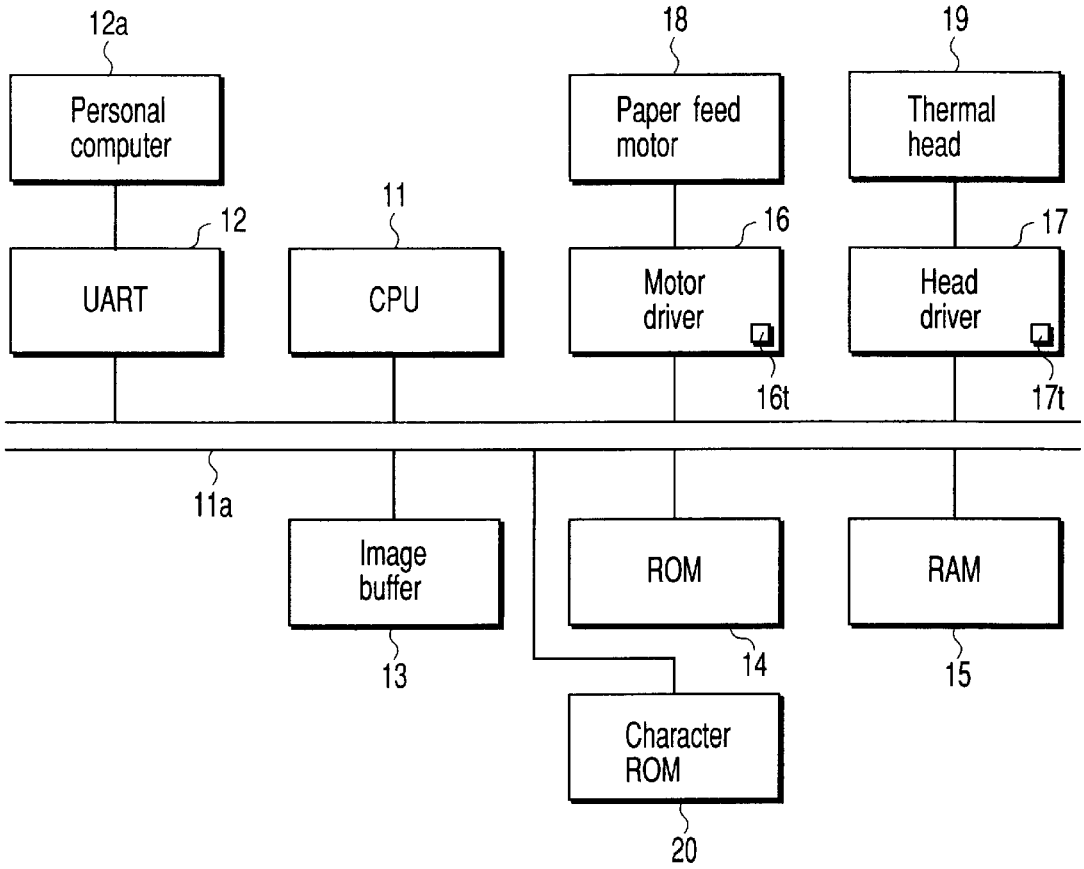
FIG. 1 is a block diagram of a thermal printer according to an embodiment of the present invention.

Hereinafter, an embodiment of the present invention will be described with reference to the drawings. FIG. 1 shows the system configuration of a thermal printer.

Figure 2:
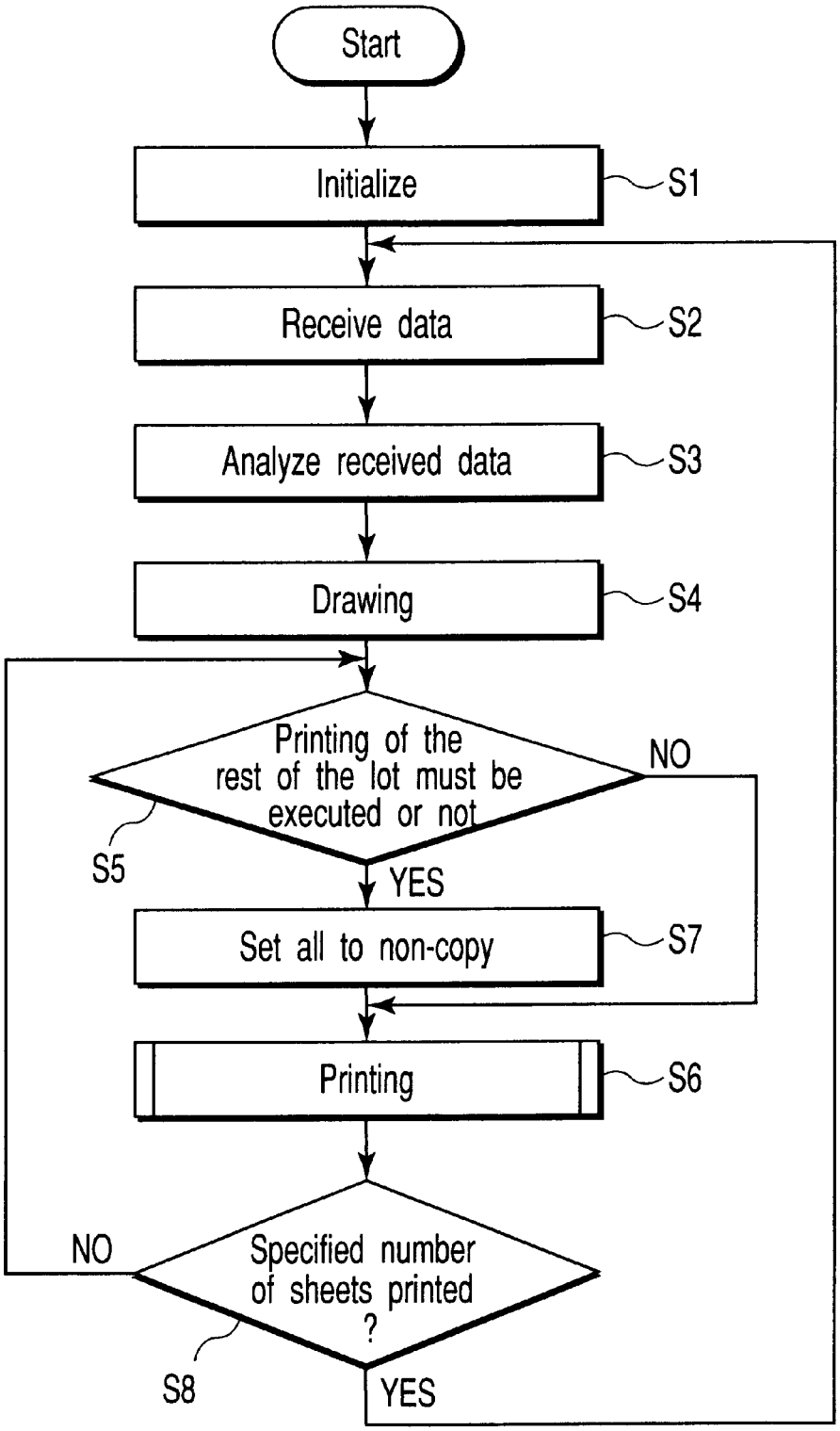
FIG. 2 is a flowchart illustrating the operation of the embodiment.
Figure 3:
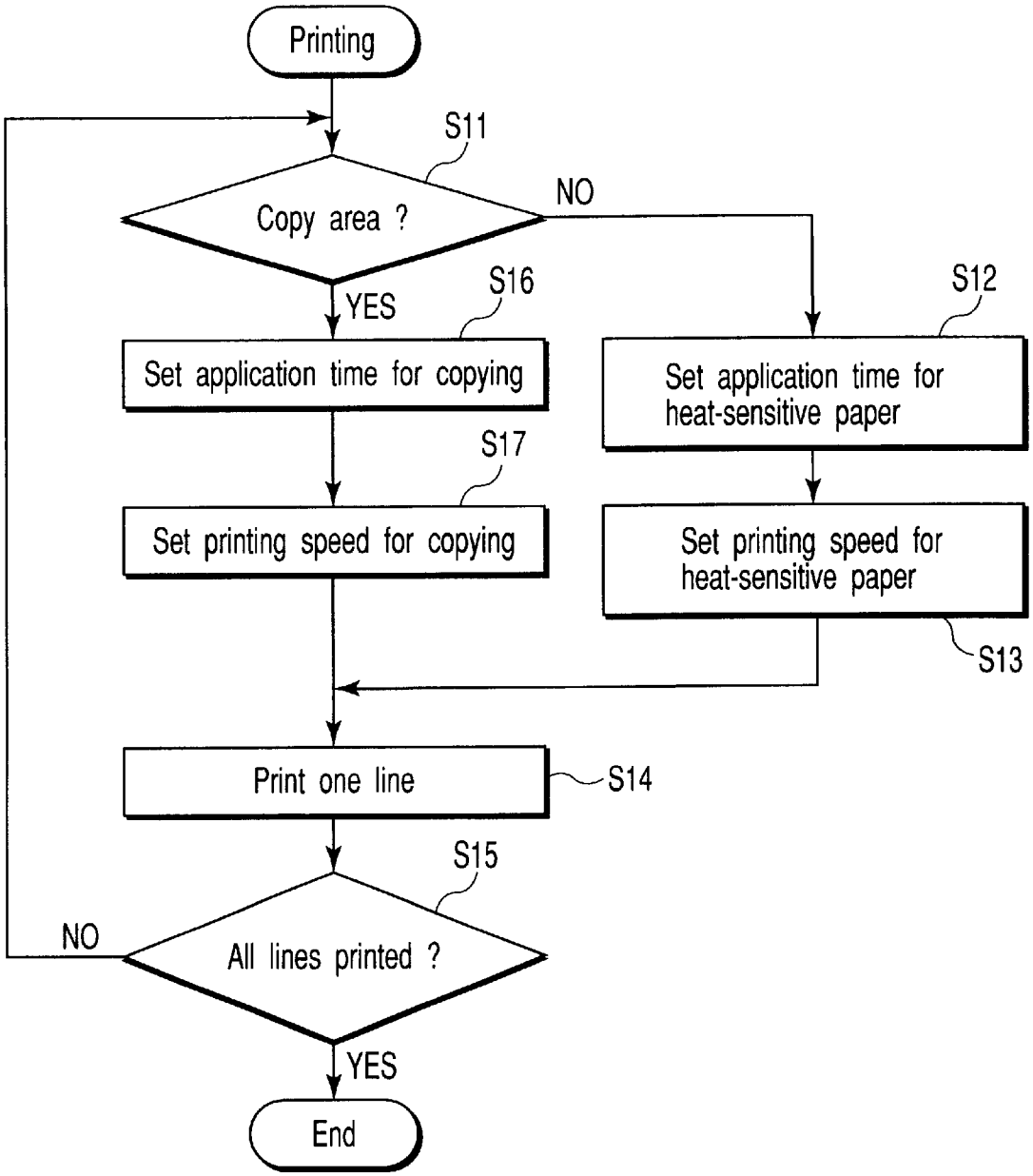
FIG. 3 is a flowchart illustrating the operation of the embodiment.

In the drawing, 11 denotes a CPU (central processing unit) that exercises control over the thermal printer. A system bus 11*a* from the CPU 11 are connected to a UART (asynchronous receiver/transmitter) 12, an image buffer 13 for storing image data to be printed onto one label, a ROM (read only memory) 14 that stores such control programs as shown in FIGS. 2 and 3, a RAM (random access memory) 15 that stores working areas, a motor driver 16 as printing speed control means, and a head driver 17 as thermal head driving means.

The motor driver 16 is equipped with a memory 16*t* which stores a printing speed V at which a continuous form is carried from when one line is printed until the next line is printed.

Figure 5:
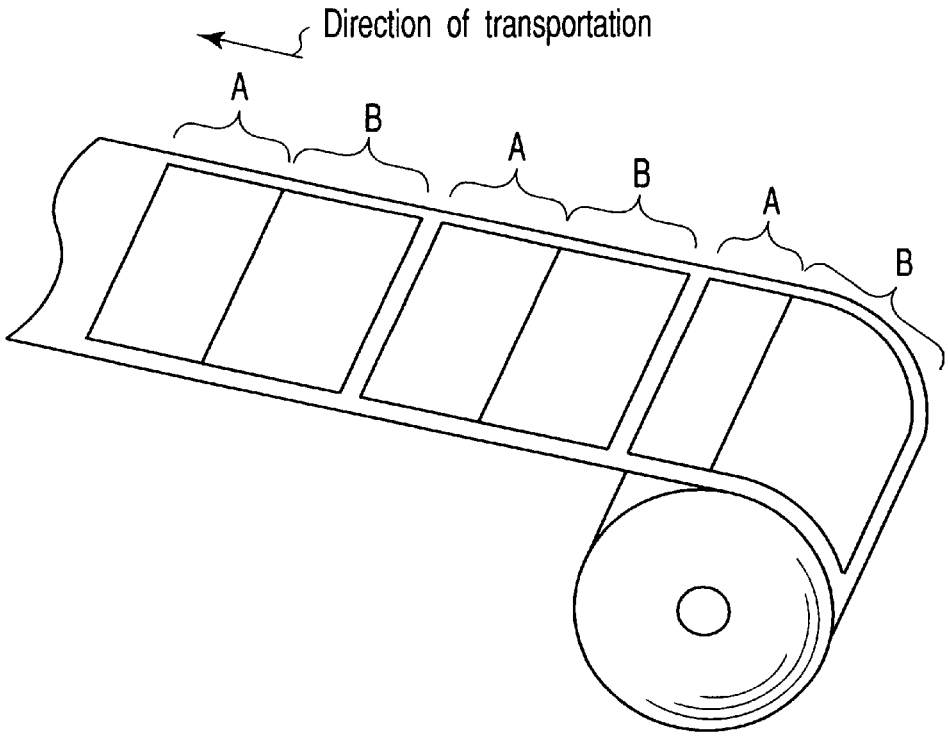
FIG. 5 shows an example of a continuous form fed into the thermal printer.

The motor driver 16 controls the driving of a paper feed motor 18 as transport means that transports a continuous form as shown in FIG. 5 on the basis of the printing speed V stored in the memory 16*t*. The paper feed motor 18 comprises a stepping motor and the printing speed V is determined by the rotational speed of the stepping motor.

A thermal head 19 is connected to the head driver 17, which has a memory 17*t* that stores an application time T which is an energizing time during which heating elements are energized to print one line. The head driver 17 controls the energization of the thermal head 19 on the basis of the application time T stored in the memory 17*t*.

The system bus 11*a* is connected to a character ROM 20, which has bit map data that converts print data sent from an externally connected personal computer 12*a* into image data. The personal computer (PC) 12*a* is connected to the UART 12.

Here, the thermal printer is fed with such a continuous form (recording medium) as shown in FIG. 5. The continuous form is pasted in succession with delivery slips each comprising an A section and a B section to form one page. Here, the A section indicates the tag section and the B section indicates the slip section.

Figure 4:
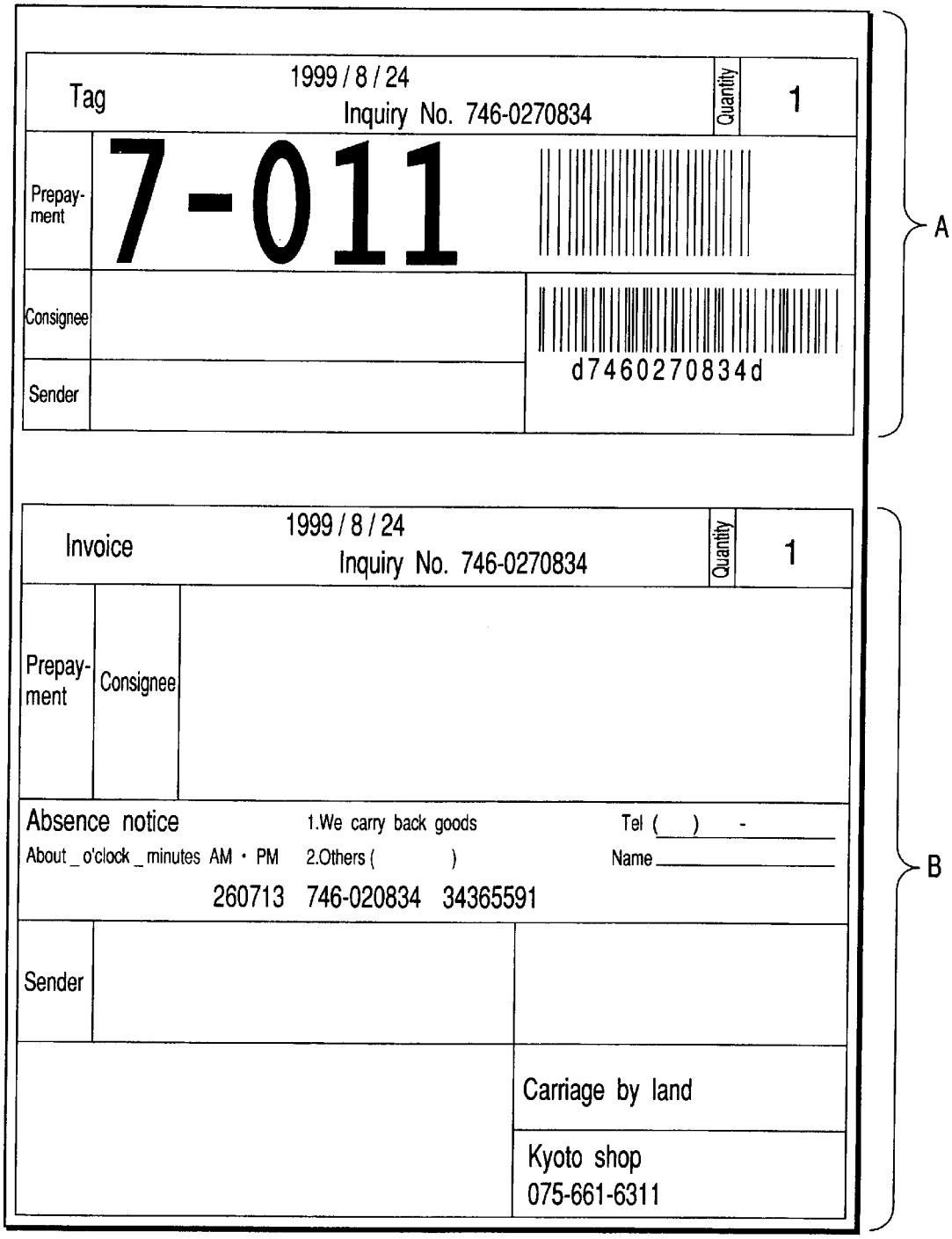
FIG. 4 shows an example of a printing of a delivery slip according to the embodiment.

FIG. 4 shows printed contents of a delivery slip for one page.

Figure 6:
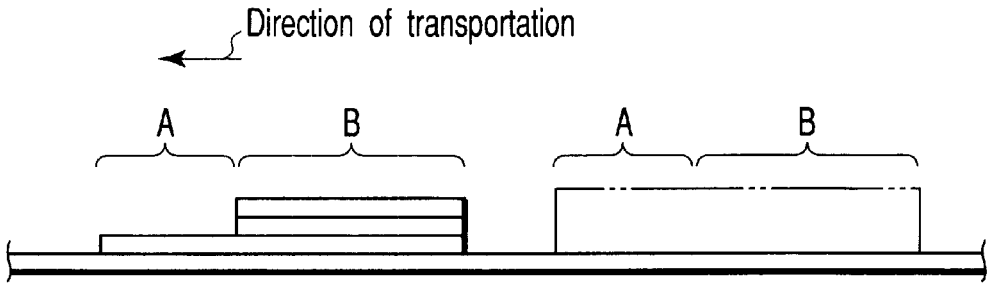
FIG. 6 is a sectional view of the main part of the continuous form.

FIG. 6 is a sectional view of the A section and the B section of the delivery slip of FIG. 5. As shown in FIG. 6, the A section is a print area where copying is unnecessary and the B section is a print area where copying is necessary. The reason is that a single tag has only to be attached to a parcel with no need of copying. On the other hand, the slip section needs copying because of the necessity of at least an invoice and a business management slip. Here, the print area A where copying is unnecessary and the print area B where copying is necessary are set by the personal computer 12*a*.

When goods to be delivered to a consignee are divided into two parcels, two delivery slips are printed. Namely, two tag sections A are required. For example, when a commodity is composed of a personal computer body and a keyboard, one tag needs to be attached to each of the personal computer body and the keyboard.

However, in printing the second delivery slip, the B section is treated as an area where there is no need of a print copy. This is because, even if goods are divided into two, they are delivered to the same consignee and the slip section B on the second delivery slip does therefore not need copying. Namely, for the slip section, the slip section B on the first delivery slip suffices.

Next, the operation of the embodiment of the present invention thus arranged will be described with reference to the flowcharts of FIGS. 2 and 3.

First, when a print command is output from the externally connected personal computer (PC) 12*a* to the label printer of the present invention, it is received by the label printer via the UART 12. The label printer is first initialized (step S1). Print data for one page, including presence or absence of a copy area and its length (specifically, in millimeters), a lot of parcels or not, and, if lot, how many parcels belong to the lot, are transmitted from the personal computer 12*a* are received by the label printer and then stored temporarily in the RAM 15 (step S2). The print data temporarily stored in the RAM 15 is subjected to analysis (step S3).

The received print data is converted by the bit map data stored in the character ROM 20 and stored in the image buffer 13 (step S4).

Then, it is determined whether printing of the rest of the lot must be executed or not (Step S5). Note that the presence of rest parcels means that printing of a plural delivery slip onto a plural sheet of paper must be executed. The presence of the rest of the lot means that the article in question consists of a plurality of parcels. Delivery slips must therefore be attached to the respective parcels. The printing of the rest of the lot means printing of the second delivery slip and all of the following delivery slips. It is determined based on data of which page of the delivery slips is to be printed whether printing of the second delivery slip and the following delivery slips must be executed.

When the determination is NO in step S5, printing is performed (step S6), described in detail later with reference to FIG. 3.

On the other hand, if YES in step S5, the A and B sections are set to non-copy (step S7). After that, printing is carried-out (step S6).

A determination is made as to whether or not the printing of a specified number of sheets has been terminated (step S8).

If the determination is NO in step S8, then a return is made to step S5.

If, on the other hand, the determination is YES in step S8, then a return is made to step S2.

Next, the printing process (step S6) in FIG. 2 will be described with reference to the flowchart of FIG. 3.

First, for printing, a determination is made as to whether or not the area is a copy area (step S11).

Here, since the A section is an area where copying is unnecessary, in printing onto the A section, the determination in step S11 will be NO.

Then, an application time adapted for normal heat-sensitive paper is set in the memory 17*t* (step S12). Further, a printing speed adapted for normal heat-sensitive paper is set in the memory 16*t* (step S13).

Subsequent to this, one line is printed out (step S14).

Next, a determination is made as to whether or not all the lines have been printed out (step S15). If the determination is NO in step S15, then a return is made to step S11.

If, on the other hand, the determination in step S11 is YES, an application time adapted for copying is set in the memory 17*t* (step S16). Here, the application time for copying is set longer than the application time for normal heat-sensitive paper.

Further, a printing speed adapted for copying is set in the memory 16*t* (step S17). Here, the printing speed for copying is set lower than the printing speed for normal heat-sensitive paper.

Since the print area where copying is unnecessary, i.e., the A section, is shorter in application time than the print area where copying is necessary, i.e., the B section, the applied energy to the print area where copying is unnecessary can be lowered. Therefore, the applied energy can be set most suitably.

Since the print area where copying is unnecessary, i.e., the A section, is set higher in printing speed than the print area where copying is necessary, i.e., the B section, the printing speed can be set most suitably. Namely, high-speed printing is allowed.

The determination of whether or not a print area is an area where copying is necessary (step S11) is made on a line-by-line basis as shown in FIG. 3. Therefore, even when one sheet is scattered with areas where copying is necessary and areas where copying is unnecessary, the applied energy can be lowered and the printing speed can be increased for print areas where copying is unnecessary.

Moreover, when delivery slips are two or more in number, all the print areas are forcedly set to areas where copying is unnecessary, preventing energy from being applied wastefully and the printing speed from being lowered.

Although the embodiment is arranged to both lower the applied energy and increase the printing speed for areas where copying is unnecessary, only the applied energy may be lowered or only the printing speed may be increased. Conversely, for areas where copying is necessary, the applied energy may be increased and the printing speed may be decreased.

In the embodiment, the print area A where copying is unnecessary and the print area B where copying is necessary are set by the personal computer 12*a*; otherwise, they may be stored beforehand in a memory (e.g., the RAM 15) in the thermal printer.

According to the present invention, as described above, in a thermal printer arranged to make printing onto a recording medium having a print area where copying is unnecessary and a print area where copying is necessary, the applied energy and the printing speed can be set most suitably.

As described above, the present invention is effective in the technical field of thermal printers that print delivery slips in the distribution business of home delivery systems.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A thermal printer that prints onto a recording medium having a print area where copying is unnecessary and a print area where copying is necessary on one page, comprising:

a thermal head; and thermal head driving means for driving the thermal head so as to decrease the energy supplied to the thermal head for the print area where copying is unnecessary below that for the print area where copying is necessary.

2. The thermal printer according to claim 1, wherein the area where copying is unnecessary and the area where copying is necessary are set up from a personal computer.

3. The thermal printer according to claim 1, wherein, when it is determined that printing extends over more than one page, the second page and later are set to an area where copying is unnecessary.

4. The thermal printer according to claim 1, wherein the recording medium is a delivery slip.

5. A thermal printer that prints onto a recording medium having a print area where copying is unnecessary and a print area where copying is necessary on one page, comprising:

transport means for transporting the recording medium; and printing speed control means for controlling the transport means so as to increase the printing speed for the print area where copying is unnecessary above that for the print area where copying is necessary.

6. The thermal printer according to claim 5, wherein the area where copying is unnecessary and the area where copying is necessary are set up from a personal computer.

7. The thermal printer according to claim 5, wherein, when it is determined that printing extends over more than one page, the second pager and later are set to an area where copying is unnecessary.

8. The thermal printer according to claim 5, wherein the recording medium is a delivery slip.

9. A thermal printer that prints onto a recording medium having a page where copying is unnecessary and a page where copying is necessary, comprising:

transport means for transporting the recording medium; and printing speed control means for controlling the transport means so as to increase the printing speed for the page where copying is unnecessary above that for the page where copying is necessary.

10. A thermal printer that prints onto a recording medium having a print area where copying is unnecessary and a print area where copying is necessary on one page, comprising:

a thermal head; and thermal head driving means for driving the thermal head so as to decrease the applied energy to the thermal head for a section in the direction in which the recording medium is transported in the print area where copying is unnecessary below that for a section in the direction in which the recording medium is transported in the print area where copying is necessary.

11. A thermal printer that prints onto a recording medium having a print area where copying is unnecessary and a print area where copying is necessary on one page, comprising:

a thermal head;

determination means for making a determination of whether or not a print page is the second page or later;

setting means for, when the determination means determines that the print page is the second page or later, setting that page as an area where copying is unnecessary; and thermal head driving means for driving the thermal head so as to decrease the applied energy to the thermal head for the print area where copying is unnecessary below that for the print area where copying is necessary.

12. A thermal printer that prints onto a recording medium having a print area where copying is unnecessary and a print area where copying is necessary on one page, comprising:

transport means for transporting the recording medium;

determination means for determining whether or not a print page is the second page or later;

setting means for, when the determination means determines that the print page is the second page or later, setting that page as an area where copying is unnecessary; and printing speed control means for controlling the transport means so as to increase the printing speed for the print area where copying is unnecessary above that for the print area where copying is necessary.

13. A thermal printer that prints onto a recording medium having a page where copying is unnecessary and a page where copying is necessary, comprising:

transport means for transporting the recording medium;

determination means for determining whether or not a page needs copying on the basis of a lot of parcels; and printing speed control means for controlling the transporting means so as to increase the printing speed for the page for which the determination is that copying is unnecessary above that for the page that needs copying.

14. A thermal printer that prints onto a recording medium having a page where copying is unnecessary and a page where copying is necessary, comprising:

a thermal head;

transport means for transporting the recording medium;

determination means for determining whether or not a page needs copying on the basis of a lot of parcels; and printing control means for driving the thermal head and controlling the transporting means so that the applied energy and the printing speed for the page for which copying is determined unnecessary are respectively decreased and increased below and above the applied energy and the printing speed for the page that needs copying.

15. A thermal printer that prints onto a recording medium having a print area where copying is unnecessary and a print area where copying is necessary on one page, comprising:

a thermal head;

transport means for transporting the recording medium; and printing control means for driving the thermal head and controlling the transporting means so that the applied energy and the printing speed for the print area where copying is unnecessary are respectively decreased and increased below and above the applied energy and the printing speed for the print area where copying is necessary.

16. A thermal printer that prints onto a recording medium having a print area where copying is unnecessary and a print area where copying is necessary on one page, comprising:

a thermal head; and thermal head driving means for driving the thermal head so as to increase the applied energy to the thermal head for the print area where copying is necessary above that for the print area where copying is unnecessary.

17. A thermal printer that prints onto a recording medium having a print area where copying is unnecessary and a print area where copying is necessary on one page, comprising:

transport means for transporting the recording medium; and printing speed control means for controlling the transport means so as to decrease the printing speed for the print area where copying is necessary below that for the print area where copying is unnecessary.

18. A method for driving a thermal printer that prints onto a recording medium having a print area where copying is unnecessary and a print area where copying is necessary on one page, comprising:

a thermal head driving step of driving the thermal head so as to decrease the applied energy to the thermal head for the print area where copying is unnecessary below that for the print area where copying is necessary.

19. The method according to claim 18, wherein the print area where copying is unnecessary is printed prior to the print area where copying is necessary.

20. A method for driving a thermal printer that prints onto a recording medium having a print area where copying is unnecessary and a print area where copying is necessary on one page, comprising:

a printing speed control step of controlling transport means for transporting the recording medium so as to increase the printing speed for the print area where copying is unnecessary above that for the print area where copying is necessary.

* * * * *